United States Patent [19]

Garjian

[11] Patent Number: 4,703,574

[45] Date of Patent: Nov. 3, 1987

[54] LUMINOUS SIGN

[76] Inventor: Michael Garjian, 417 Turnpike St., Stoughton, Mass. 02072

[21] Appl. No.: 804,183

[22] Filed: Dec. 3, 1985

[51] Int. Cl.[4] ..... G09F 17/00

[52] U.S. Cl. ..... 40/545

[58] Field of Search ..... 40/545, 542, 550, 551

[56] References Cited

U.S. PATENT DOCUMENTS

| | | | |
|---|---|---|---|
| 714,233 | 11/1902 | Plancon | 40/545 |
| 1,743,569 | 1/1930 | Purdom | 40/545 |
| 2,852,877 | 9/1958 | Goebel et al. | 40/545 |
| 3,507,065 | 4/1970 | Fullerton | 40/545 |

*Primary Examiner*—John J. Wilson
*Assistant Examiner*—Wenceslao J. Contreras
*Attorney, Agent, or Firm*—Albert O. Cota

[57] ABSTRACT

A luminous sign (10) comprising three sandwiched plates: a front transparent legend plate (12) incorporating a legend (12*a*), a center feedthrough plate (14) having a set of termination bores (14*a*) and crossover bores (14*b*), and a back crossover cavity plate (16) having a first and second power/gas input bore (16*b*) (16*c*) and a crossover cavity (16*a*) across each set of crossover bores (14*b*). When all three plates are aligned and hermetically bonded a continuous gas passage is provided through the first power/gas input bore (16*b*), termination bore (14*a*), legend (12*a*), crossover bore (14*b*), through the crossover cavity (16*a*), a crossover bore (14*b*) and again through the legend (12*a*). The gas path continues through subsequent passages terminating at the second power/gas input bore (16*c*). Into the power/gas input bores (b 16*b*) (16*c*) is hermetically inserted a tubulated electrode (18) and a non-tubulated electrode respectively. When neon gas is captively inserted into the tubulated electrode (18) and electrical power is applied to the electrodes, the gas ionizes causing the legend (12*a*) to glow.

14 Claims, 12 Drawing Figures

LUMINOUS SIGN

TECHNICAL FIELD

The invention pertains to the general field of luminous signs employing an ionized gas to illuminate a legend and more particularly to an improved luminous sign constructed of three sandwiched plates where the first plate incorporates the legend and the second and third plates combine to provide a continuous path for the legend illuminating gas.

BACKGROUND ART

Luminous signs employing a gaseous discharge legend and the methods for making these signs have been disclosed in several patents. In general, these signs are made by using two or three confronting plates where in one or two of the plates is formed a groove or cavity corresponding to the desired legend. The cavity is contiguously attached to a gas entry port incorporating a set of electrodes. In the manufacturing process the cavity is evacuated and a quantity of gas, such as neon, is inserted under pressure and temperature into the cavity through the gas entry port which is then hermetically sealed. The partially pressurized gas is then ionized by applying a voltage across the electrode set. The ionized gas, in turn, causes the legend to illuminate.

The basic problems associated with manufacturing these luminous signs lies in the method used to insulate the crossover point between two overlapping segments of a legend such as in the letter "X" or between any two letters.

This problem and the solution proposed by prior disclosure is discussed in the prior art section below.

A search of the prior art did not disclose any patents that read directly on the claims of the instant invention, however the following United States patents were considered related:

| U.S. PAT. NO. | INVENTOR | ISSUED |
|---|---|---|
| 2,852,877 | Goebel, et al | 23 September 1958 |
| 2,158,968 | Moffat | 16 May 1939 |
| 1,937,957 | Hotchner | 5 December 1933 |
| 1,825,399 | Hotchner | 29 September 1931 |

The Gobel patent discloses two embodiments for making a luminous sign. The first consists of a transparent panel and an opaque backing panel. A groove is cut into the confronting face of the transparent panel to form the letters. The groove extends continuously from one end of the plate to the other with a tube inserted in each end into which a gas, such as neon, is introduced to the groove. The spaces between the letters are made nonluminous by inserting an opaque channel shaped shield.

In the second Goebel embodiment, a transparent plate confronts an opaque plate which then confronts a second transparent plate. A groove corresponding to the legend is formed on each plate. The crossover is accomplished by etching or grinding a precision recess into one of the plates at the crossover point. A corresponding precise fitting glass block with a connecting groove is then inserted into the recess where the block acts as an insulator between the two intersecting channels. Due to the precision required between the recess and block, it is extremely difficult and costly to create a good seal. In complex legends hundreds of crossover points may exist requiring hundreds of precisions recesses and blocks adding further to the cost.

The placement of the precision block into its recess can also cause problems when applying and curing adhesives as differences in the coefficients of thermal expansion of the adhesives and glass will cause stresses or cracks when the sign is heated to 450 degrees Farenheit, the temperature considered to be the absolute minimum temperature to decontaminate the neon filled channels to effect optimum illumination. The failure of only one out of number of block/recess in locations becomes evident only after final fabrication and bonding of the lamination. Thus, one small hairline leak in the seal can render the entire sign useless. Additionally, this technique results in the reduction of the cross-sectional area of the gas filled channel as it passes through the blocks, thus causing the luminous intensity and heat output of the gas to increase significantly.

The Moffat patent discloses a method for constructing an incandescent gas sign in which three plates of plastic or glass are hermetically attached in a sandwiched fashion. The front and back plates are flat and confront a middle plate that has a gas containing channel, representing a legend, cut therethrough. A gas receiving opening with an electrode is located on one end of the channel and another electrode is located on the other end of the channel. The electrodes are used to ignite and illuminate the gas.

The first listed Hotchner patent discloses a luminous sign constructed of a light transmitting plate having a light source secured around the perimeter of the plate. The faces of the plate are covered with a reflective film. This film confines the transmitted light within the plate except in those areas where the film has been removed to simulate a legend. Thus, the legend becomes luminous to the eye.

The second listed Hotchner patent discloses a method for fabricating a flat tubeless ionization conductor device. The device comprises two glass plates having legend channels etched in an offset such that the channel may crossover itself without creating a short circuit. This is accomplished by etching each channel with an offset portion that is undercut when formed leaving an overhanging lip extending from the edge over the groove. The opposing lip separates the two superposed portions of the discharge passage at each return bend in the passage. An alternative crossover method is to burrow a tunnel below the surface of the plate such that a bridge of glass remains over the tunnel which may then pass underneath another channel in the legend. Although both methods are possible, they are impractical as they require precision etching which would be very impractical and time consuming if a large number of crossover points were necessary. Further, although it is possible to etch a short tunnel into a glass plate, it is practically impossible to etch a curved tunnel or one of longer length as would be required for complex legends.

DISCLOSURE OF THE INVENTION

The inherent design and manufacturing methodology of the improved luminous sign allows a variety of simple to complex legends to be illuminated at maxiumum efficiency. The invention also lends itself to allowing many color combinations to be applied to the legend and/or legend background.

The invention arose out of the need for an improved method to manufacture neon signs and legends. Current methods require the bending of glass tubes into complex shapes and legends. Problems arise due to the lack of skilled craftsmen, high labor costs, lack of manufacturing economies due to the unautomated nature of the bending process, limited creative potential, and high maintenance costs due to fragility. These methods of manufacturing neon signs have virtually remained unchanged since 1923.

Although there exists prior art in this area, the previous patents covering this art possess inherent problems. From a manufacturing point of view, prior art designs are physically impractical, difficult to produce, are not cost effective, and are aesthetically limited. Most of these problems arise out of the methods used to insulate crossover points in the legend. Unless crossover points, such as in the letter "X", are not insulated, a short circuit will occur and render the legend useless or severely diminished.

The instant invention not only updates the manufacturing technology, but also eliminates most, if not all, of the problems associated with the manufacturing methodology presently in use. Thus, it is the primary object of the invention to manufacture neon and other luminous gas signs where a legend is made by forming a legend cavity into a front transparent plate, insulating the legend crossover points, by means of a center feedthrough plate located between the front plate and a back crossover cavity plate that incorporates the legend crossover cavities.

Another object of the invention is to facilitate the creation of complex legend designs. This feat is now possible and practical because of the inventive crossover insulation method.

Another object is to simplify the manufacturing process. Since only simple cavity forming and glass drilling techniques are required, a multiplicity of crossover points may be made to several stacked plates simultaneously using currently available automated machinery.

Another object is to produce a sign that lends itself in terms of practicality and ease to the use of many color producing chemicals and/or color coatings on both the legend and/or the legend background.

In addition to the above, it is also an object of the invention to produce a luminous sign that:

is not size limited, has a higher yield rate than existing designs thus, further increasing its cost effectiveness, allows flexibility in mounting by allowing the electrodes to be positioned in the side or back, and that is reliable and maintenance free.

BEST MODE FOR CARRYING OUT THE INVENTION

Figure 1:
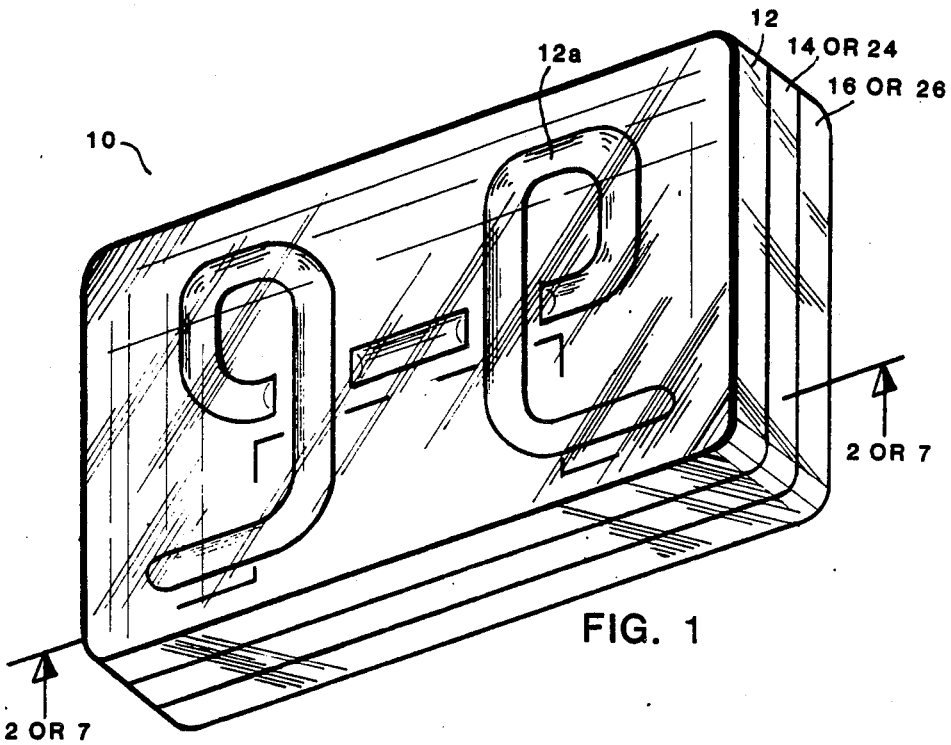
FIG. 1 is a perspective view of the completed luminous sign applicable to both the first and second embodiments.

The best mode for carrying out the inventive improved luminous sign 10, is presented in terms of a preferred embodiment, a second embodiment and modifications that are applicable to both embodiments. In addition to the structural disclosure, there is also disclosed a process for constructing the sign.

The preferred embodiment of the sign 10, as shown in FIGS. 1–6, is comprised of three major elements: a front transparent legend plate 12, a center feedthrough plate 14, a back crossover cavity plate 16; a tubulated electrode 18 and a non-tubulated electrode 20. To complete the sign's utility, an external power source 30 is also required.

Figure 2:
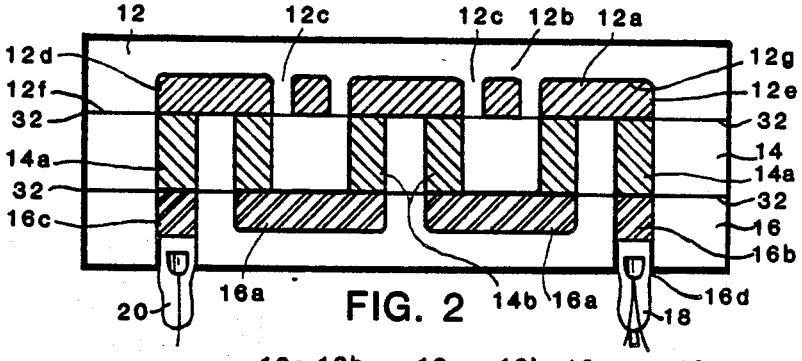
FIG. 2 is a cross-sectional side view of the completed luminous sign in the preferred embodiment.
Figure 3:
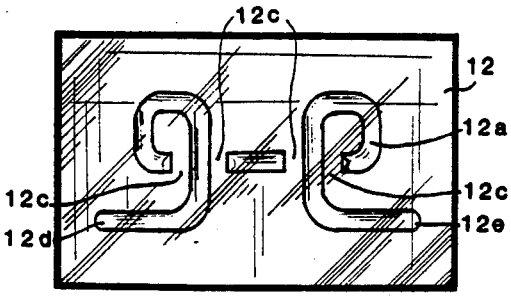
FIG. 3 is a plan view of the upper side of the front transparent legend plate as used in both the preferred and second embodiments.
Figure 6:
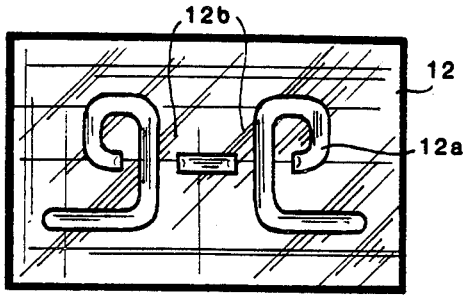
FIG. 6 is a plan view of the backside of FIG. 3.

The front transparent plate 12, as shown in FIG. 2 in cross section and in FIGS. 3 and 6 in a front and back views respectively, functions as the frontal plate from where the selected legend is viewed. The plate may be constructed of either plate glass or plastic. The legend 12*a*, as shown in FIGS. 1 and 3, consists of a legend cavity that is formed from the backside of the plate 12. The cavity is formed by a cavity producing means which includes an etching process, sandblasting, grinding, a laser beam or any other cavity producing methods. In addition to the above, the legend cavity may also be formed by molding or vacuum forming the front transparent legend plate over a mold incorporating the legend. This method is well known in the art and therefore is not described or shown in the drawings.

Each segment of the legend must terminate at a legend crossover intersection 12*b*. For example, in the legend depicted in FIGS. 1 and 3, there are two crossover intersections 12*b* where each intersection includes two crossover points 12*c*.

Figure 4:
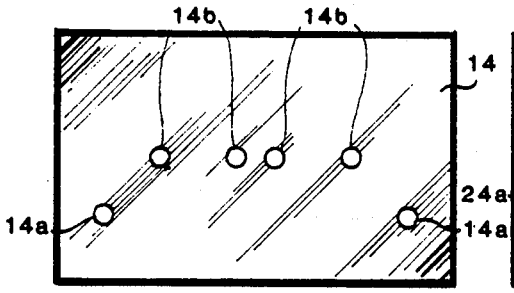
FIG. 4 is a plan view of the center feedthrough plate of the preferred embodiment.

The center feedthrough plate 14, as shown in cross section in FIG. 2 and in a plan view in FIG. 4, provides the bores that allow a continuous (uninterrupted) gas flow to occur from the legend beginning end 12*d*, through each of the crossover intersections 12*b* and to the legend ending end 12*e*. This plate is sandwiched between the front transparent plate 12 and the back crossover cavity plate 16 that is described infra. The plate 14 has a termination bore 14*a* therethrough in alignment with the legend beginning end 12*d* and the legend ending end 12*e*. There is also a crossover bore 14*b* that is in alignment with each legend crossover point 12*c* of every legend crossover intersection 12*b*.

Figure 5:
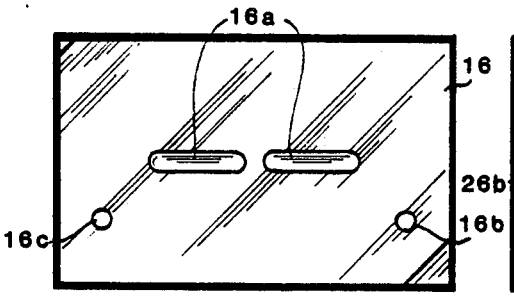
FIG. 5 is a plan view of the upper side of the back crossover cavity plate of the preferred embodiment.

The final plate necessary to complete the first embodiment of the luminous sign 10 is the back crossover cavity plate 16 shown in cross section in FIG. 2 and in an upper side plan view in FIG. 5. This plate includes the input and output connections to the power source and includes on its top side the crossover cavities 16*a* that function with the crossover bores 14*b* to maintain gas continuity between the legend crossover intersections 12*b*.

Each crossover cavity extends over the area encompassing each of the legend crossover intersections 12b located on the front transparent legend plate 12 and across the respective crossover bores 14b located on the center feedthrough plate 14. The back crossover cavity plate 16 also has a power/gas input bore 16b, 16c in concentric alignment with each of the respective termination bores 14a located on the center feedthrough plate 14.

The second embodiment of the sign 10 is shown in FIGS. 1, 3, 6, 7, 8 and 9. This embodiment is also comprised of three major elements: a front transparent legend plate 12, a center crossover cavity/bore plate 24, a back feedthrough plate 26, a tubulated electrode 18, and a non-tubulated electrode 20. As with the first embodiment an external power source 30 is also needed.

The front transparent legend plate 12 is dimensionally and functionally identical to that of the preferred embodiment, therefore no further description is required.

Figure 7:
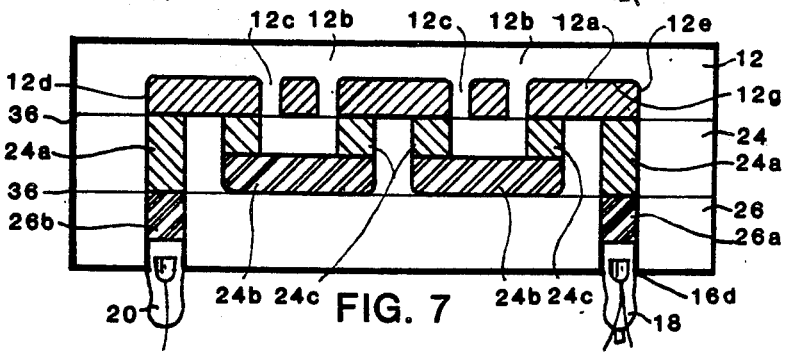
FIG. 7 is a cross-sectional side view of the completed luminous sign in the second embodiment.
Figure 8:
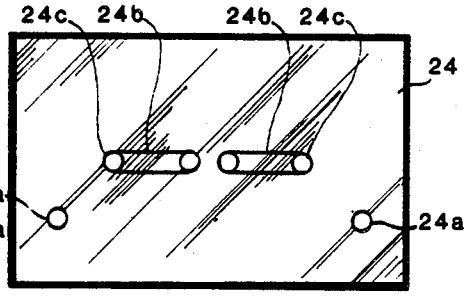
FIG. 8 is a plan view of the upperside of the center crossover cavity/bore plate of the second embodiment.

The center crossover cavity/bore plate 24, shown in cross section in FIG. 7 and in an upperside plan view in FIG. 8, provides the bores and cavities that allow an uninterrupted gas flow from the legend beginning end 12d through each of the crossover intersections 12b, and to the legend ending end 12e. This plate is sandwiched between the front transparent legend plate 12 and the back feedthrough plate 26 described infra. The plate 24 has a termination bore 24a therethrough in alignment with the legend beginning end 12d and the legend ending end 12e. The plate also includes the crossover cavities 24b that are formed into its bottom side. The crossover cavities extend over the area encompassing each of the legend crossover intersections 12b located on the front transparent legend plate 12. Each crossover cavity 24b also has two crossover bores 24c where each bore, as best shown in FIG. 7, is located within the cavity 24b at each end. The bores 24c extend upwardly and interface with the ends of the applicable legend crossover point 12c.

Figure 9:
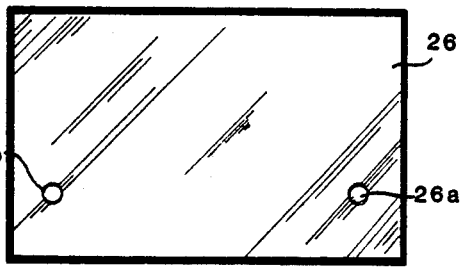
FIG. 9 is a plan view of the back feedthrough plate of the second embodiment.

The final plate necessary to complete the second embodiment of the luminous sign 10 is the back feedthrough plate 26 shown in cross section in FIG. 7 and in a plan view in FIG. 9. This plate provides the input and output connection to the power source 30. The plate 26 is the least complex of all the other plates in that it only includes a set of power input bores 26a, 26b. Each of the bores 26a, 26b are in concentric alignment with each of the respective termination bores 24a located on the center crossover cavity/bore plate 24.

In the discussion that follows, each of the refinements, procedures and manufacturing steps described are applicable to both the first and second embodiment of the luminous sign 10.

To further enchance the aesthetic qualities of the luminous sign, an opaque coating 12f of various legend contrasting colors may be applied to the legend background area on the backside of the front transparent legend plate 12 as depicted in FIG. 2. The coating 12f is preferably applied prior to forming the legend 12a. Thus, when the legend is formed, the coating is dissolved from the legend permitting light to be transmitted only through the legend 12a.

To compliment the colored legend background the legend 12a may also be coated on its backside with a light transmissible, background contrasting coating or preferably with a color selectable phosphorescent chemical coating 12g as depicted in FIG. 2.

As a further aesthetic refinement a plurality of different phosphorescent chemicals may be applied to the legend surface at selected intervals. In this manner, the legend 12a will radiate in a plurality of colors. By combining a specific phosphorescent chemical with a specific gas, various color combinations and derivatives may be produced as shown in TABLE I.

TABLE I

| CHEMICAL | GAS | COLOR |
|---|---|---|
| Manganese and lead activated Calcium | Argon | Pink |
| MetaSilicate ($CaSiO_3$:Mn:Pb) | Neon | Red |
| Lead activated Calcium Tungstate | Argon | Blue |
| ($CaWO_4$:Pb) | Neon | Pink |
| Zinc Orthosilicate:Manganese | Argon | Green |
| ($ZnSiO_4$:Mn) | Neon | Gold |
| Yttrium Oxide:Europium ($Y_2O_3$:Eu) | Argon | Red |

By blending the above chemicals with each other or with other available phosphorescent chemicals, an even greater variety of colors may be produced.

In applying the phosphorescent chemical coating 12g, it is important to avoid applications which are too thick as the chemical itself can block the passage of light from the ionized gas. Thicknesses ranging between 0.0014 to 0.0018 inches (35 to 40 microns) are considered best for maximum light emission.

To construct the luminous sign 10 several steps such as plate alignment, hermetic bonding, and gas insertion and encapsulation are required. Each of these manufacturing steps are next described and are applicable to the design as disclosed or to more complex designs where the legend is more complex and may be designed with several independent gas passages employing different gases and several electrodes.

The alignment of the plates 12, 14, 16 or 12, 24 26 may be simply accomplished by accurately cutting two adjacent edges in each panel that serve as registration edges. The angular cut must be identical and at the same location for all three plates. Another method that may be employed is to affix to each plate in at least three corners a registration mark, such as a dot or cross.

Duplicate copies of the legend are then attached to each of three plates such that the distance on each plate of any point on the legend to the registration edge or registration mark is identical.

Thus, when the plates are stacked, so that the registration marks are aligned or the registration edges are flush with each other, the legend image will be automatically aligned within each plate. After the alignment is verified, the required bores and cavities are formed and the plates are hermetically bonded.

The hermetic bonding process is generally accomplished by using high temperature-sensitive adhesives 32 such as epoxies or silica containing sealants. The type of adhesive used and the temperature needed depends on whether the plates are glass or plastic. Typically, for glass plates, the epoxies required for this purpose cure at temperatures between 200° to 350° F. (93° to 177° C.) over a curing period of from 2 to 16 hours depending on the epoxy used.

In addition to the heat, the plates must be cured under a compressive force to assure hermeticity. The force required is between 6 to 30 pounds per square inch (0.42 $Kg/Cm^2$ to 2.1 $Kg/Cm^2$) depending on the viscosity of the epoxy or sealant being used.

The adhesive is generally applied over the entire surface of one of the contiguous plates or it may be applied selectively on one of the contiguous plates around the outside surface circumference of each of the bores 12*a*, 14*b* and 16*b*, 16*c* and around the outside perimeter of the legend 12*a* and crossover cavity 16*a*. The importance in either method used is to maintain hermeticity between the bores, cavities and inside plate perimeter.

An additional bonding process that may be employed is to apply the selected adhesive to only the inside perimeter surface of the plates. When using this method it is especially critical to apply sufficient pressure to cause the plates to achieve a tight maximum surface contact. The use of this method does pose a problem; if the plate(s) has surface inconsistencies, the path of the gas may follow these inconsistencies, due to the lower resistance offered, and a short circuit may result.

To reduce or eliminate the occurrence of short circuit(s), a very thin gasket 36 of insulation material may be placed on the top and bottom surface of the center plate 14, 24 as shown in FIG. 7. The insulation material may be composed of a separate fine glass cloth that is laid on the plates or fine glass fibers or powder may be sprayed or deposited onto the plates by a deposition means. The important requirements of the material used is that it withstand the high compression and temperatures and that it outgas during the heating process to prevent contamination of the legend passages. By using this insulative method, the edges of the bores and cavities are better insulated to assure the required hermeticity. In practice the insulative material may be placed on the plates prior to having the required bores or cavities on the plates drilled or sandblasted. Thus, when such drilling or sandblasting occurs the insulative material from the bores or channels is automatically removed.

A tubulated electrode 18, as shown in FIGS. 2 and 7, is hermetically inserted into the first power/gas input bore 16*b*, 26*a* and a non-tubulated electrode 20 is hermetically inserted into the second power/gas input bore 16*c*, 26*b*. The electrodes 18, 20 have a diameter that allows a tight fit when inserted into the respective power/gas input bores. Thus, a hermetic seal 16*d* is easily accomplished by applying a fillet of epoxy or sealant around the circumference of the interface. The seal is then cured by using a conventional heating process.

Figure 10:
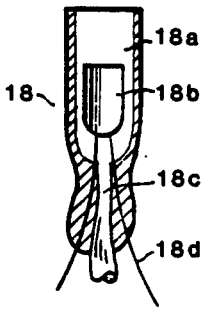
FIG. 10 is a cross-sectional side view of a typical tubulated electrode.
Figure 11:
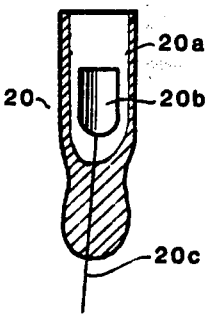
FIG. 11 is a cross-sectional side view of a typical non-tubulated electrode.
Figure 12:
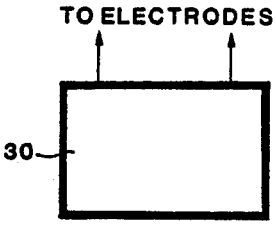
FIG. 12 is a representative block diagram of a power source.

The tubulated electrode 18, as shown in FIG. 10, is comprised of a primary glass tube 18*a* having within this tube a hermetically contained metallic electrode shell 18*b* connected to a set of electrical lead-in wires 18*d* that extend outside the glass tube 18*a*. Hermetically attached to the end of the primary glass tube 18*a* is a gas input tube 18*c* that provides a passage through the electrodes 18 into the legend passage way. The non-tubulated electrode 20, as shown in FIG. 11, has no gas input tube and is only comprised of a primary glass tube 20*a* having hermetically encapsulated therein an electrode shell 20*b* having an electrical lead-in wire extending out from the end of the glass tube 20*a*.

If a tubulated electrode 18 is not used, that is, the gas input is separate from the electrical lead-in wire, then the gas is simply inserted through a small diameter glass gas tube (not shown) that is hermetically inserted into the legend gas passage way.

After the tubulated electrode 18 and non-tubulated electrode are hermetically attached the structure of the luminous sign 10 is complete. At this point, the ionizable gas may be introduced into the gas input tube 18*c* of the tubulated electrode 18. The gas input is commenced after the sign's temperature has been elevated to at least 450° F. (232° C.) while under a partial vacuum. If the gas is not inserted and a vacuum maintained while the plates are being cooled from the lamination and electrode insertion process, it will be necessary to reheat and re-evacuate the structure before gas is introduced.

A vacuum is accomplished by connecting a vacuum pump (not shown) to the gas input tube 18*c* of the tubulated electrode or the optimal glass gas tube. The connection to the gas input tubes are not made directly from the vacuum pump but rather from the pump to a control manifold (not shown) then from the manifold to the gas input tubes. The manifold, which is of a conventional type used in traditional neon shops, is comprised of glass tubes and vacuum tight stopcocks. When a vacuum pressure of approximately 15 microns is reached, the pump is isolated by means of a stopcock. The vacuum is applied at a temperature between 450° F. and 500° F. (232° and 260° C.) The temperature should not drop below 450° F. (232° C.) because at these lower temperatures organic substances will not be drawn off by the partial vacuum and the structure will be contaminated. A contaminated structure will cause the neon not to glow or if it does glow the use life of the luminous sign 10 will be shortened.

The vacuum is maintained until the structure is cooled to 150° F. (66° C.) or less at which time the neon gas or argon is introduced into the gas input tube 18*c* by opening another stopcock on the manifold that is connected to the source of neon or argon gas. When the appropriate gas pressure is reached, as shown in TABLE II, the glass tube 18*a* of the tubulated electrode 18 is heated to a molten state causing the partial pressure within to draw the molten tube walls inward creating a hermetic seal. The completed luminous sign 10 is then removed from the manifold.

The gas pressure of the gas introduced into the structure is dependent on the average cross sectional area of the bores and cavities within the plates 12, 14, 16 or 12, 24, 26. Assuming that the cross section is equal to that of a tube of a given diameter, then the pressures necessary are given in TABLE II.

TABLE II

| Tube Diameter (Millimeters) | Cross Section (Square Millimeters) | Gas Pressures (Millimeters Mercury) |
|---|---|---|
| 25 | 491 | 6 |
| 22 | 380 | 7 |
| 20 | 314 | 7.5 |
| 18 | 254 | 8 |
| 15 | 177 | 9 |
| 14 | 154 | 10 |
| 13 | 133 | 10 |
| 12 | 113 | 11 |
| 11 | 95 | 12 |
| 10 | 78 | 13 |
| 9 | 64 | 15 |
| 8 | 50 | 16 |
| 7 | 38 | 16.5 |
| 6 | 28 | 17.5 |
| 5 | 20 | 18.5 |
| 4 | 12.5 | 19.5 |
| 3 | 7 | 20.5 |
| 2 | 3 | 21.5 |

The above pressures are for normal room temperature conditions. If the temperature is lower, the listed pressures may vary by several millimeters or up to 20 percent higher. If the temperature at which the gas is introduced is higher due to previous heating, an appropriate adjustment must be made in accordance to Boyle's Law covering pressure verus temperature.

To complete the utility of the luminous sign 10 a power source 30 is connected across the electrical lead-in wire 18*d* and 20*c* located on the tubulated electrode 18 and non-tubulated electrode 20 respectively. The power source 30 is preferably an a-c power supply operating at 60 Hz and rated to supply the required voltage and current to ionize the gas within the sign 10. However, a d-c power supply as well as high frequency power supplies may also be employed.

Although the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the claims.

I claim:

1. An improved luminous sign comprising:

(a) a front transparent legend plate having a legend consisting of a legend cavity that is formed from the backside of said plate where said legend has a beginning end and an ending end and said legend is interrupted at each legend crossover intersection, (b) a center feedthrough plate located behind said front transparent legend plate and having a termination bore therethrough in alignment with the beginning end and the ending end of said legend and also having a crossover bore in alignment with each legend crossover point of every crossover intersection, (c) a back crossover cavity plate located behind said center feedthrough plate and having a crossover cavity on its top side that extends over the area encompassing each of the legend crossover intersections on said front transparent legend plate and across the respective crossover bores on said center feedthrough plate with said back crossover cavity plate also having a first power/gas input bore and a second power/gas input bore where each bore is in concentric alignment with each of the respective termination bores on said center feedthrough plate, (d) means to align all three of said plates in the order indicated, (e) means to hermetically bond all three of said plates in the order indicated, (f) means to insert and hermetically encapsulate within the confines of the encapsulated legend cavities an optimum quantity of ionizable gas, and (g) means to activate said ionizable gas such that said gas causes a luminous radiation across said legend.

2. An improved luminous sign comprising:

(a) a front transparent legend plate having a legend consisting of a legend cavity that is formed from the backside of said plate where said legend has a beginning end and an ending end and said legend is interrupted at each legend crossover intersection, (b) a center crossover cavity/bore plate located behind said front transparent legend plate and having a crossover cavity on its bottom side that extends over the area encompassing each of the legend crossover intersections with each crossover cavity having two crossover bores where each of said bores is located within the cavity at each end and where said crossover bores extend upwardly interfacing with the ends of the applicable legend crossover point and with said center crossover cavity/bore plate also having a termination bore in alignment with the beginning and ending end of said legend, (c) a back feedthrough plate located behind said center crossover cavity/bore plate and having a first power/gas input bore and a second power/gas input bore where each bore is in concentric alignment with each of the respective termination bores on said center crossover cavity/bore plate, (d) means to align all three of said plates in the order indicated, (e) means to hermetically bond all three of said plates in the order indicated, (f) means to insert and hermetically encapsulate within the confines of the encapsulated legend cavities an optimum quantity of ionizable gas, and (g) means to activate said ionizable gas such that said gas causes a luminous radiation across said legend.

3. The improved luminous sign as specified in claims 1 or 2 wherein said legend cavity is formed by a cavity producing means.

4. The improved luminous sign as specified in claims 1 or 2 wherein said legend cavity is formed by molding said front transparent legend plate over a mold incorporating the legend.

5. The improved luminous sign as specified in claims 1 or 2 further comprising an opaque coating that is applied to the legend background area or the backside of said front transparent legend plate, where said opaque coating permits light to be transmitted only through said legend.

6. The improved luminous sign as specified in claim 5 wherein the legend background area is coated with a legend contrasting color.

7. The improved luminous sign as specified in claim 5 wherein said opaque coating is applied prior to forming said legend cavity.

8. The improved luminous sign as specified in claims 1 or 2 further comprising a color selectable phosphorescent chemical that is applied to the legend cavity surface, where said phosphorescent chemical allows said legend to radiate in selectable colors.

9. The improved luminous sign as specified in claim 8 wherein a plurality of different phosphorescent chemicals are applied to the legend cavity surface at selected intervals so that said legend illuminates in a plurality of colors.

10. The improved luminous sign as specified in claims 1 or 2 wherein said means to align all three of said plates is accomplished by precisely cutting on each of said plates two adjacent edges that form an angle where the edges of said angle serve as registration edges.

11. The improved luminous sign as specified in claims 1 or 2 wherein said means to hermetically bond all three of said plates is accomplished by:

(a) selectively applying a temperature-sensitive adhesive to the contacting surface on each of said plates.

(b) aligning said plates, (c) compressing said plates by a compression means, and (d) allowing said plates to cure under compression and temperature.

12. The improved luminous sign as specified in claims 1 or 2 wherein said means to hermetically bond all three of said plates is accomplished by applying a gasket of insulation material on the top and bottom surfaces of said center plate.

13. The improved luminous sign as specified in claims 1 or 2 wherein said means to insert and hermetically encapsulate within the confines of the encapsulated legend cavities an optimum quantity of ionizable gas is accomplished by:

(a) inserting and hermetically sealing a tubulated electrode into said first power/gas input bore, (b) inserting and hermetically sealing a non-tubulated electrode into said second power/gas input bore, (c) applying and maintaining a vacuum to the tubulated section of said tubulated electrode while said sign is at an elevated temperature, (d) inserting said ionizing gas through tubulated section of said tubulated electrode, and (e) heating said tubulation to a molten state to cause the partial pressure within said tubulated electrode to draw the molten tube walls inwardly to create a seal.

14. The improved luminous sign as specified in claims 1 or 2 wherein the means to ionize said gas is accomplished by applying an electrical current across the electrodes on said tubulated electrode and non-tubulated electrode.

* * * * *